US005955934A

United States Patent [19]

Raj

[11] Patent Number: 5,955,934

[45] Date of Patent: Sep. 21, 1999

[54] QUIET FERROFLUID SOLENOID WITH CUSHION

[75] Inventor: Kuldip Raj, Merrimack, N.H.

[73] Assignee: Ferrofluidics Corporation, Nashua, N.H.

[21] Appl. No.: 09/048,571

[22] Filed: Mar. 26, 1998

Related U.S. Application Data

[63] Continuation-in-part of application No. 08/697,624, Aug. 28, 1996.

[51] Int. Cl.[6] ..... H01F 3/00

[52] U.S. Cl. ..... 335/277; 335/257; 335/279; 335/280; 335/281; 335/229; 335/234

[58] Field of Search ..... 335/229–234, 335/251, 255, 257, 271, 277, 279, 280, 281

[56] References Cited

U.S. PATENT DOCUMENTS 4,306,207 12/1981 Tada et al. ..... 335/234
4,419,643 12/1983 Ojima et al. ..... 335/234
4,422,060 12/1983 Matsumoto et al. ..... 335/256

FOREIGN PATENT DOCUMENTS 052177 7/1981 European Pat. Off. .
57071108 5/1982 Japan .

*Primary Examiner*—Lincoln Donovan
*Assistant Examiner*—Raymond Barrera
*Attorney, Agent, or Firm*—Kudirka & Jobse, LLP

[57] ABSTRACT

A solenoid includes a ferrofluid in gaps between the moving and stationary elements which ferrofluid reduces noise caused by activating a plunger positioned within the solenoid. A permanent magnet can be included as a solenoid element to increase magnetic field strength within the solenoid to retain the ferrofluid within the solenoid. A cushion located between the plunger and a butt toward which it moves also reduces the noise, while the ferrofluid maintains a relatively high solenoid force relative to a solenoid with air gaps.

18 Claims, 11 Drawing Sheets

QUIET FERROFLUID SOLENOID WITH CUSHION

CROSS-REFERENCE TO RELATED APPLICATIONS

This application is a continuation-in-part of U.S. patent application Ser. No. 08/697,624, filed Aug. 28, 1996.

FIELD OF THE INVENTION

The present invention relates a solenoid construction and in particular to a ferrofluid-based solenoid which includes a movable plunger surrounded by a ferrofluid.

DESCRIPTION OF THE RELATED ART

A plunger solenoid is a device which includes an electrically energizable coil wound on a non-magnetic form within which a magnetic plunger may move. A solenoid includes a mechanical stop or butt to restrict plunger movement. The stop or butt is made of a magnetically permeable material. The non-magnetic form or spool, electrically energizable coil, plunger and mechanical stop are surrounded by a ferromagnetic casing such as steel which is formed of two parts. The casing includes a generally cylindrical element which surrounds the solenoid element and a pole piece. The plunger butt and pole piece are made of soft magnetic materials that can retain varying degrees of residual magnetism depending upon their composition. Since the solenoid contains no permanent magnetic field, the magnetic field is produced only when the coil is energized. When the coil is energized by passing an electrical current therethrough, a magnetic field is produced in and around the core volume within which the plunger is positioned. The casing, plunger, butt and pole piece together form a magnetic circuit which intensifies the magnetic flux in the air gaps between the plunger and the butt as well as between the plunger and the pole piece. As a result of the magnetic field in the core volume, the movable plunger is pulled toward a central position within the coil. The more intense the magnetic field in the gaps between the plunger and the butt and between the plunger and the pole piece, the greater the force on the plunger.

Solenoids are widely used for operating circuit breakers, track switches, valves and many other electromechanical devices. Thus, the movable plunger may be attached to any one of variety of mechanical elements such as a seat of a valve, the movement of which can be utilized to control flow of gases or liquid through the valve. In use, as the moving plunger approaches the butt, the mechanical force of the moving plunger increases rapidly due to a decrease in the reluctance of the magnetic flux path. The plunger strikes the butt with maximum force thereby creating noise, vibrations and chattering in the solenoid. A significant problem associated with solenoids is that they tend to generate noise, caused by the plunger striking the butt and by the plunger rubbing against the walls of the core defined by the interior surface of the spool. The impact force against the butt and the frictional force against the core walls create wear particles which can cause wear on the plunger and on the spool which, in turn, limit the life of the solenoid. Typically, the plunger displacement is small such as less than 1 mm and the radial clearance between the plunger and the core wall is about 0.1 mm. In addition, the clearance between the pole piece and the plunger is also about 0.1 mm. Since there is no alignment mechanism for the plunger within the solenoid, the plunger may scrape the walls of the core, causing undesirable wear.

Noise generated by solenoid devices such as solenoid valves pose serious restrictions in their use in apparatus which must perform quietly. For example in medical applications such as dialysis machines, blood chemistry instruments, blood pressure monitors and ventilators/respirators, it is necessary that valves be quiet to assure patient comfort. Presently this is achieved by placing excessive acoustic foam insulation around the apparatus which renders the apparatus large and bulky and therefore undesirable.

Ferrofluids are magnetically responsive materials and consist of three components: magnetic particles, a surfactant and a liquid carrier. The particles, typically $Fe_3O_4$, are of submicron size, generally about 100 Å in diameter. The magnetic particles are coated with a surfactant to prevent particle agglomeration under the attractive Van der Waals and magnetic forces and are dispersed in the liquid carrier. Ferrofluids are true colloids in which the particles are permanently suspended in the liquid carrier and are not separated under gravitational, magnetic and/or acceleration forces. The liquid carrier can be an aqueous composition, an oil composition or an organic solvent composition.

Accordingly, it would be desirable to provide solenoids which can be activated while eliminating or substantially reducing noise. In addition it would desirable to provide such a solenoid which can be activated over long periods while minimizing or preventing solenoid wear. It would also be desirable to provide a solenoid having an improved heat dissipation characteristics and improved resistance to corrosion by chemically active environments within which the solenoid is placed.

SUMMARY OF THE INVENTION

The present invention provides a solenoid which includes a ferrofluid surrounding a portion of a plunger positioned within the solenoid and at least a portion of a butt piece having a surface which stops plunger movement within the solenoid. The ferrofluid is positioned within a gap between the plunger and a non-magnetic spool which supports a coil, a gap between the plunger and the butt and a gap between the plunger and the pole piece. The ferrofluid reduces the noise produced by the actuated plunger since the ferrofluid positioned between the butt and the plunger acts as a cushion for the moving plunger. In addition, the ferrofluid minimizes the production of noise caused by undesirable vibration of various solenoid elements, particularly the plunger.

The ferrofluid positioned within the solenoid also provides additional operating advantages of the solenoid. The ferrofluid provides excellent lubrication of the moving parts of the solenoid since the ferrofluid includes a lubrication liquid. This, in turn, materially reduces wear of the solenoid since production of wear particles caused by frictional and impact forces is materially reduced. Since ferrofluids can be manufactured from a wide variety of liquids for suspending ferromagnetic particles, the damping coefficient of the ferrofluid can be varied over a wide range depending upon the liquid used in the ferrofluid. In addition, since the ferrofluid surrounds the plunger, magnetostatic forces on the plunger effect its alignment within the core of the solenoid, thereby providing an additional means for reducing wear.

While the ferrofluid minimizes noise levels by converting undesirable vibrational energy into heat through the viscous shear effect, the ferrofluid also functions as a larger heat sink as compared to the air in present solenoids so that the ferrofluid not only dissipates heat caused by vibration energy, it dissipates the heat from the energized winding.

This, in turn, reduces coil temperature and coil resistance; thereby improving the power rating of the solenoid. Furthermore, since ferrofluids are a soft magnetic material, they exhibit no magnetic losses when present in the gap. Lastly, since the substrate liquid comprising ferrofluids is substantially chemically inert, its presence within the gaps of the solenoid prevent the elements of the solenoid adjacent the gaps from corroding due to chemically active environments within which the solenoid may be placed.

The ferrofluid-based solenoids of this invention also can include additional elements which cooperate with the ferrofluid to enhance the solenoid's performance characteristics. In one embodiment, a permanent magnetic can be affixed to an end of the solenoid opposite an end from which the plunger extends. The magnet increases the magnetic field of the solenoid when it is activated. In another embodiment, the surface of the butt most closely positioned to the plunger can be modified to provide one or more reservoirs for the ferrofluid or can be configured to provide a more focused magnetic field within the gap between the plunger and the butt. A permanent magnet also can be positioned at the same end of the solenoid from which the plunger protrudes in order to increase the magnetic field in the volume of the solenoid adjacent the pole piece. A permanent magnet also can be positioned within the solenoid between the pole piece and the coil in order to increase the magnetic field within that volume of the solenoid. In another embodiment, the butt can be formed from a permanent magnet to increase the magnetic field within the volume of the solenoid occupied by the butt. In another embodiment, a permanent magnet can be affixed to the casing in order to provide retention of greater amounts of ferrofluid between the butt and the pole piece thereby reducing noise and increase damping of the plunger's movement.

The ferrofluid is maintained within the solenoid by existing magnetic flux within the gaps within the solenoid under both static and dynamic conditions. Unlike non-magnetic materials such as oil or grease, the ferrofluid will not leak from the solenoid.

In operation, when the coil is electrically energized, the plunger is pulled into the solenoid. The ferrofluid positioned within the gap between the plunger and the spool functions to lubricate the movement of the plunger and to center the plunger within the core volume defined by the interior wall of the spool. As the plunger approaches the butt to a position where it will be stopped within the solenoid, the ferrofluid positioned between the plunger and the butt absorbs the impact force of the plunger so that, if the plunger actually contacts the butt, the impact force on the butt is materially reduced or eliminated thereby materially reducing or eliminating noise caused by the impact force. In addition, the centering and lubricating effects of the ferrofluid on the plunger materially reduce or eliminate the frictional force on the spool by the plunger thereby also materially reducing noise caused by the frictional force. Since the ferrofluid possess a higher magnetic permeability than air, its presence within the plunger effects an increased force on the plunger which can be balanced against the viscosity of the ferrofluid having the effect of dampening the force of the plunger. These effects can be controlled thereby to control the response time and force by the plunger over a wide range. Thus the solenoid of this invention provides reduced noise and increased flexibility of operating characteristics for the solenoid as compared to presently available solenoids which utilize a gas, such as air, within the solenoid gaps.

In one alternative embodiment of the invention, a cushion is located between the plunger and the butt. The cushion reduces the level of acoustic noise which would otherwise occur from actuation of the solenoid. The cushion may be attached to either, or both, of the plunger and butt. The cushion material is preferably selected to have good chemical compatibility with the ferrofluid, and to withstand an expected temperature range from −20° C. to 70° C. The cushion may, alternatively, take the form of a coating on the surface of either, or both, of the plunger and butt.

DESCRIPTION OF THE PREFERRED EMBODIMENTS

Figure 1:
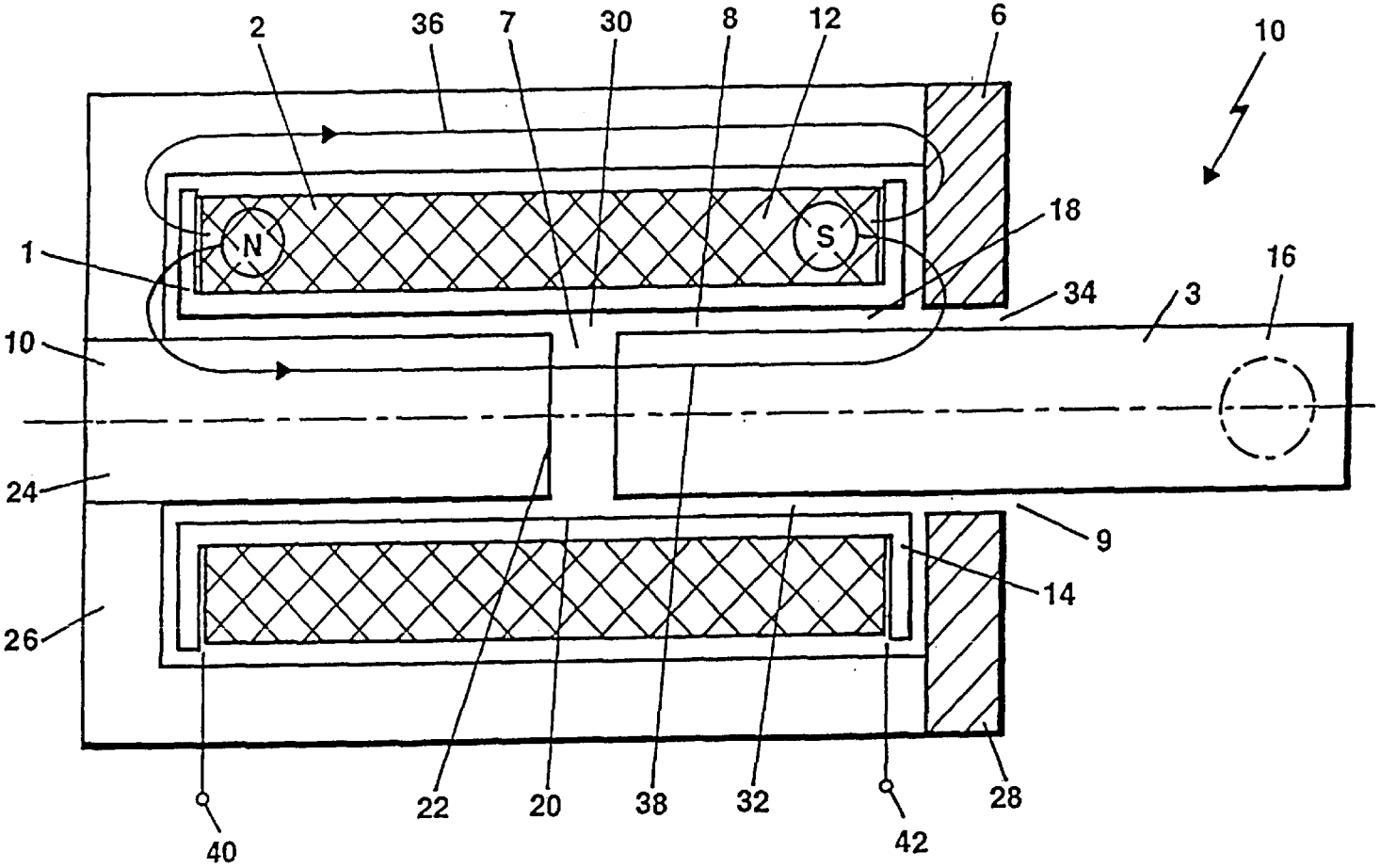
FIGURE 1 (PRIOR ART)
FIG. 1 is a cross sectional view of a prior art solenoid.

The solenoid of this invention includes an insulated low resistance wire such as a copper wire wound on a nonmagnetic spool support made, for example, from a polymeric composition. A plunger formed of a magnetically permeable material is positioned within the core volume of the spool and is free to move within the core volume. A mechanical stop or butt also is positioned within the core volume of the spool. The butt is also formed of a magnetically permeable material but is not free to move within the core volume within the spool. The butt is conveniently fixed in position by securing it to the inside surface of the spool which defines the core volume. A casing for the spool, wire coil, plunger and butt is formed of two pieces which are positioned to secure the other solenoid elements in place. One piece of the casing is a generally cylindrical element and the second piece of the casing is a generally circular flat element, referred to as the pole piece and which is secured to the generally cylindrical element. Small gaps containing a ferrofluid are provided between the butt and the spool, between the plunger and the spool and between the plunger and the butt.

For use in the present invention, it is preferred that natural or synthetic oil based ferrofluids be utilized. The synthetic oils provide high thermal stability, wide operating temperature range, very low volatility and excellent lubrication properties. Representative suitable synthetic oils include hydrocarbons, esters, silicones, silahydrocarbons, polyphenyl ether, fluorocarbons, chlorofluorohydrocarbons or the like. Generally, in the absence of an external magnetic field, ferrofluids behave like ordinary liquids as if possessing no magnetic properties and therefore will leak out of the working gap of a device in the absence of a magnetic field. This is due to the fact of that the magnetic moments of individual particles in a zero field cancel out and the net magnetization of the fluid is zero. When a magnetic field is applied to the fluid, the magnetic vectors orient themselves along the field lines resulting in a net magnetic moment of the fluid. The force that retains a ferrofluid in a magnetic gap is a product of the magnetic moment of the fluid and the magnetic field strength in the gap.

Magnetic materials utilized to form the plunger, butt and pole piece of the solenoid can retain varying degrees of residual magnetism depending upon their composition. When the magnetization of the ferrofluid is sufficiently high, it can be retained within the solenoid by the residual induction of the soft magnetic materials in the static condition. Under dynamic conditions, when the accelerating forces are large, the additional magnetic field produced by the coil ensures further retention of the ferrofluid within the solenoid. Thus, the working solenoid provides a sufficient permanent magnetic field to prevent the ferrofluid from leaking from the solenoid through gap between the plunger and the spool or pole piece. Embodiments of this invention are provided which include a permanent magnet positioned at various locations within the solenoid and are described in more detail below with reference to the figures. These permanent magnets provide an increased magnetic field and thereby further increase dampening, reduce wear, decrease noise level and provide centering force to the plunger within the core volume. The ferrofluids utilized in the present invention generally have a viscosity between about 50 and 25,000 cp at 27° C., have an evaporation rate less than 10–8 gm/cm2-C at 100° C. and a relative magnetic permeability of about 1.1 to 5.5. Ferrofluids which have a viscosity of about 2,000 cp at 27° C. or higher are retained within the solenoid merely by viscous effects without the need for a residual magnetic field. When utilizing a permanent magnet in the solenoid of the this invention, the permanent magnet is positioned so that the field produced by the magnet extends in the same direction as the primary field produced by the energized coil. Typical permanent magnets are formed from ferrites, AlNiCo, Sn—Co and Nd—Fe—B.

Referring to FIG. 1, a prior art solenoid is illustrated. The solenoid 10 includes an electrically energizable coil 12 such as a copper coil which is wound about a spool 14 formed of a non-magnetic material. A plunger 16 formed of a magnetic material is positioned within core volume 18 defined primarily by the inside cylindrical wall 20 of spool 14. The plunger 16 is movable within core volume 18 between the top surface 22 of butt 24 and to a position which is regulated by the strength of the magnetic field produced by energized coil 12. The butt 24 is fixed to the casing 26 and/or the inside wall 20 of spool 14. The butt is formed from a magnetic material. The housing for the solenoid 10 is formed from a casing 26, formed from a magnetic material and a pole piece 28, also formed from a magnetic material. The plunger 16 extends through the pole piece 28. A gap 30 is provided between the butt 24 and the plunger 16 to permit movement of the plunger 16. A gap 32 between the plunger 14 and the pole piece 16 and a gap 34 between the plunger 16 and the pole piece 28 also permit the plunger 16 to move within the solenoid 10. In the prior art device, the gaps 30, 32 and 34 contain air. The magnetic flux lines for the solenoid 10 are illustrated by lines 36 and 38. The electrical energy applied to leads 40 and 42 of coil 12 can be either AC or DC electrical energy and generates a magnetic field within the solenoid.

Figure 2:
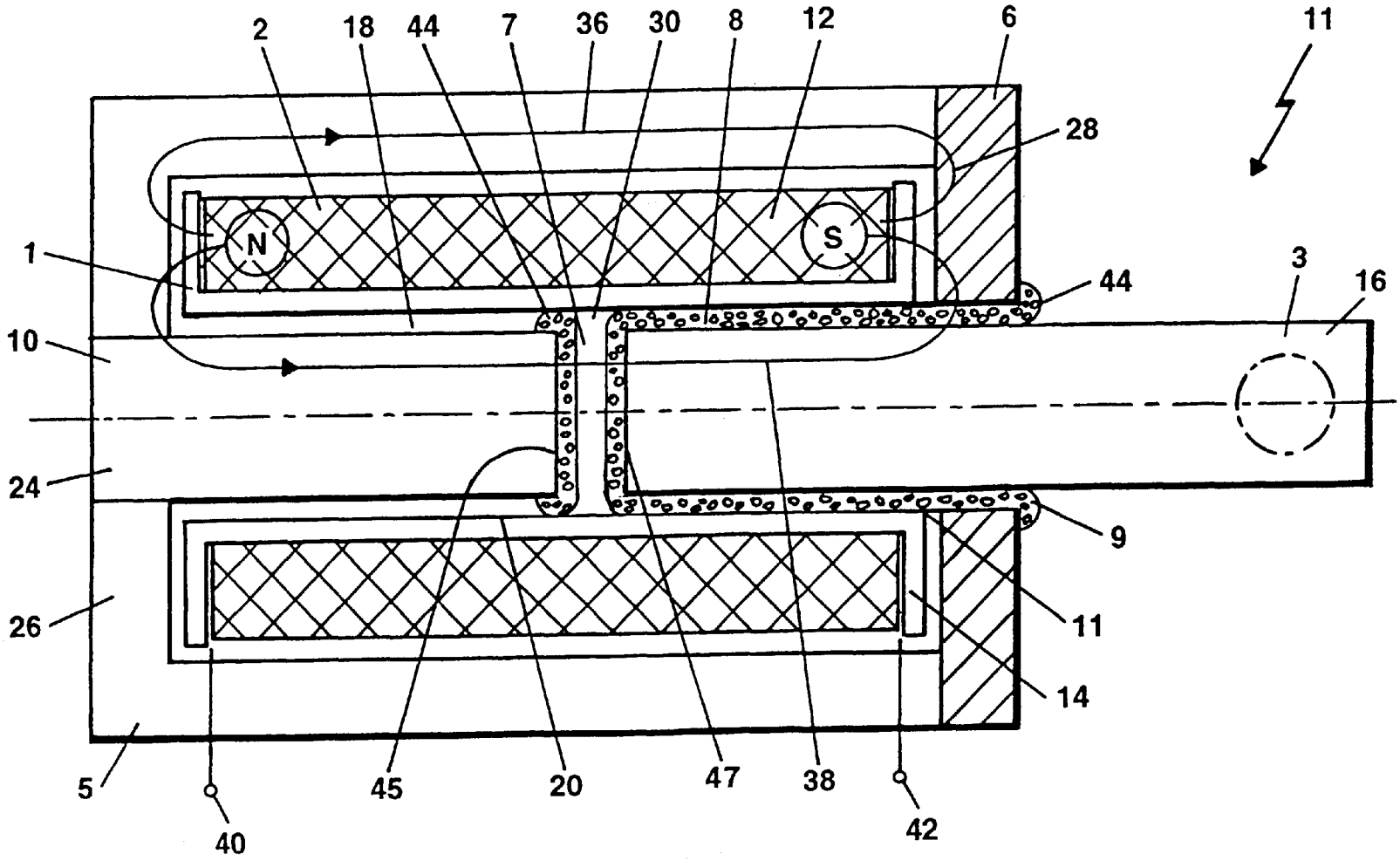
FIG. 2 is a cross sectional view of a solenoid of this invention.

FIGS. 2–9 illustrate various embodiments of the invention. In FIGS. 2–9 like elements to the elements of FIG. 1 will be referred to by the same reference numbers. Referring to FIG. 2, the solenoid 11 includes an electrically energizable coil 12 which is energizable by applying a voltage between leads 40 and 42, a spool 14 formed a non-magnetic material, a movable plunger 16 formed from a magnetic material, a non-movable butt 24 formed from magnetic material, a casing 26 formed from a magnetic material and a pole piece 28 formed from a magnetic material. A ferrofluid 44 is positioned (a) within the gap 30 between the plunger 16 and the butt 24, (b) within a gap between the butt 24 and the interior wall 20 of the spool 14 and (c) within the gap between the inner wall 20 of spool 14 and the plunger 16. Under influence of the magnetic field, the ferrofluid 44 coats the face surface 45 of the butt 24 and the face surface 47 of the plunger 16. The magnetic flux lines are illustrated by lines 36 and 28 when the coil 12 is electrically energized. The ferrofluid 44 positioned within gap 30 provides the functions set forth above, particularly reducing or eliminating noise by cushioning the impact between the movable plunger 16 and the stationary butt 24. The ferrofluid 44 positioned between the plunger 16 and the inner wall 20 of the spool 14 also provides the functions set forth above, to center the plunger 16 within the core volume 18 and to minimize or prevent friction between the movable plunger 16 and the stationary wall 20.

As shown in the figures, when the plunger 16 is away from the butt 24, a gap exists between them. Residing in this gap is some finite amount of gas, such as air. When the solenoid is activated, and the plunger 16 moves toward the butt 24, this gas is displaced past a magnetic seal formed by the ferrofluid 44, typically venting to atmosphere. Thus, as the plunger 16 approaches the butt 24, a series of pressure increases and releases occur within the gap as the pressure capacity of the ferrofluid seal is repeatedly overcome by the compressed gas, and the seal repeatedly reforms. This provides a unique damping effect for the solenoid embodiments of the present invention.

Figure 3:
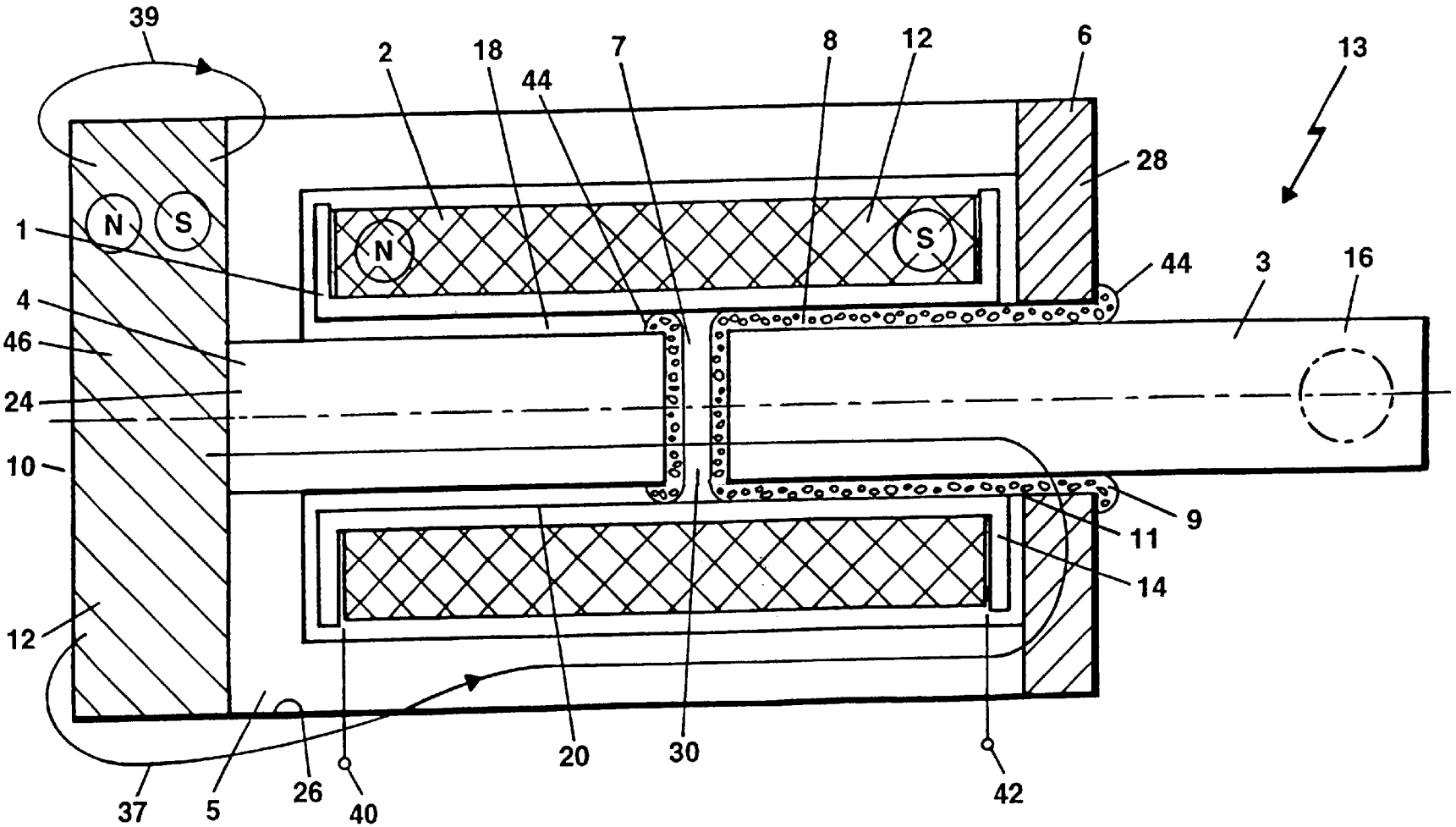
FIG. 3 is a cross sectional view of a solenoid of this invention including a magnet positioned on the fixed side of the solenoid.
Figure 4:
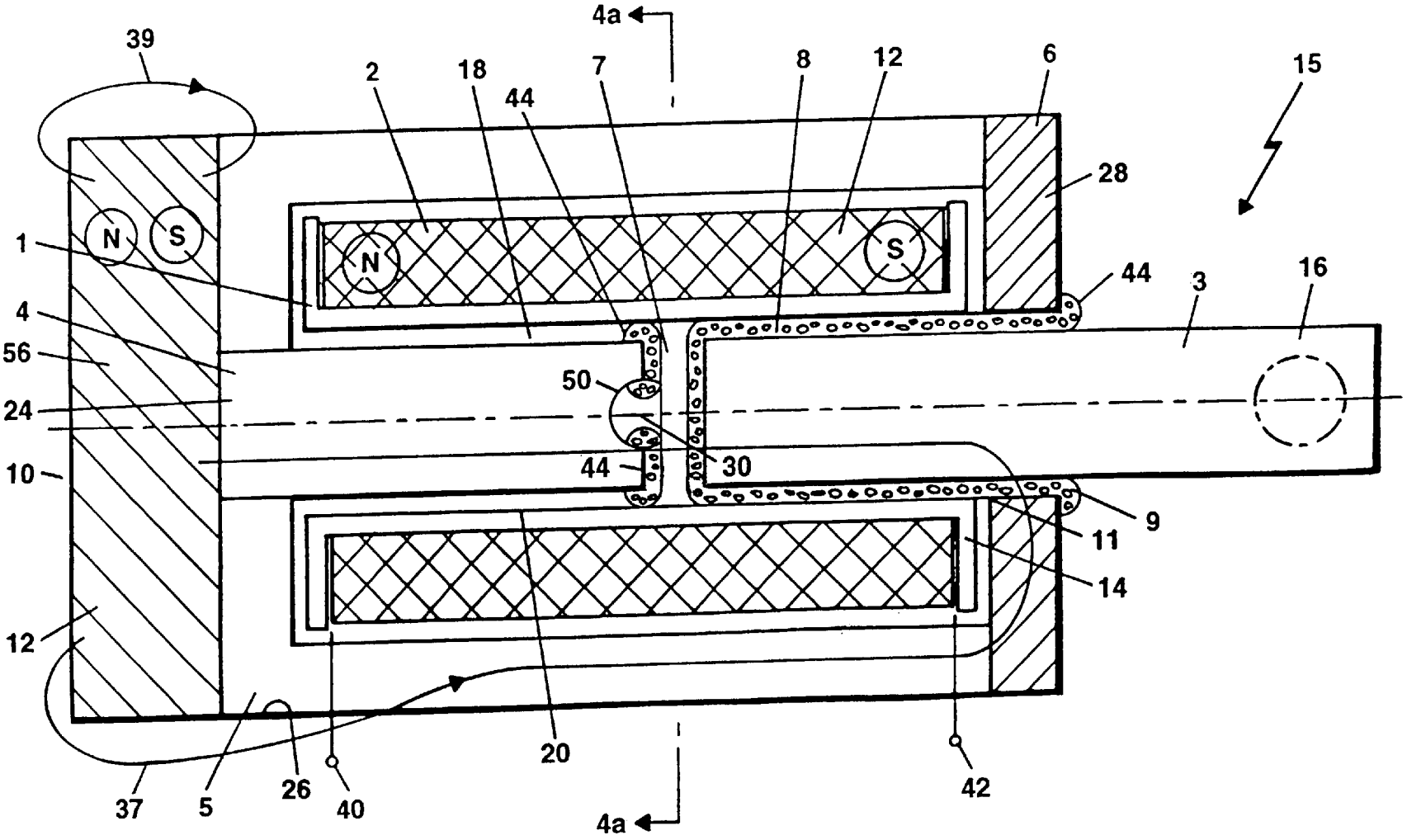
FIG. 4 is a cross sectional view of a solenoid of this invention including a reservoir on the butt element.
Figure 4A:
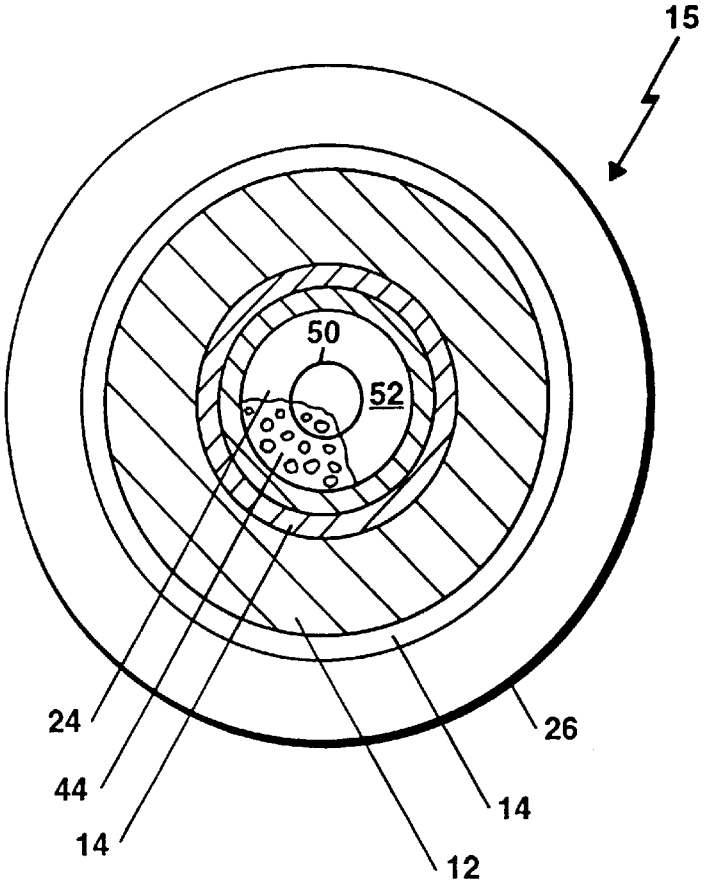
FIG. 4A is a top view in the area of the butt element of FIG. 4

Referring to FIG. 3, in another embodiment the solenoid 13 includes an electrically energizerable coil 12, a spool 14 which supports the coil 12 a movable plunger 16, an immovable butt 24, a casing 26, leads 40 and 42 and a pole piece 28. The solenoid 13 includes a permanent magnet 46 attached to the casing 26 outside of the core volume 18. A ferrofluid 44 is positioned (a) in the gap 30 in contact with both the butt 24 and the movable plunger 16, (b) within the space between inner wall surface 20 of spool 14 and the plunger 16 and (c) the gap between wall 20 and butt 24. The magnetic flux lines of solenoid 13 are depicted by lines 37 and 39. The magnet 46 improves retention of the ferrofluid 44 within the solenoid 13. The ferrofluid 44 functions in the manner described above to provide the advantages described above, particularly with reference to the description of FIG. 2. Referring to FIGS. 4 and 4*a* in a further embodiment, the solenoid 15 includes an electrically energizable coil 12, a spool 14, a movable plunger 16, a stationary butt 24, a casing 26, leads 40 and 42 and a pole piece 28. The butt 24 includes a depression 50 on its top surface 52 which functions as a reservoir for ferrofluid 44. When the gap 30 is reduced due to the motion of the plunger 16, the ferrofluid 44 is compressed into the reservoir 50 by the mechanical force of the moving plunger 16. During a reverse stroke of the plunger 16 where the gap 30 is increased, the ferrofluid is pulled out of the reservoir 50 by the magnetic field within the gap 30. The permanent magnet 46 provides the magnetic flux lines 37 and 39.

Figure 5A:
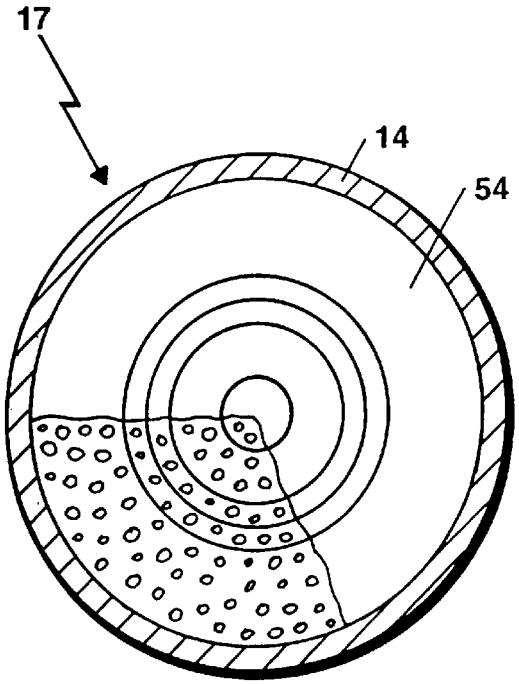
FIG. 5A is a top view of the butt element of FIG. 5.
Figure 5:
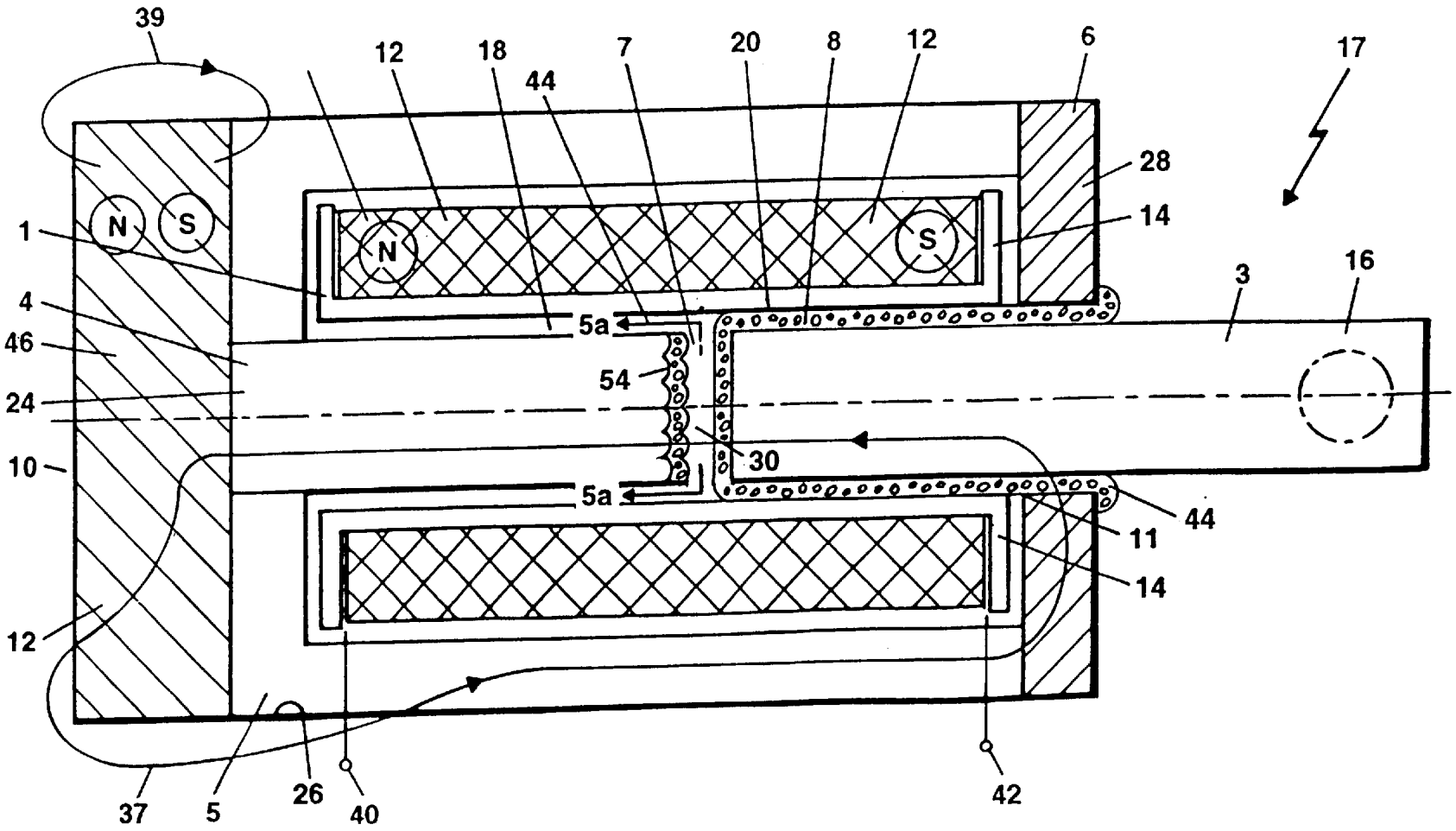
FIG. 5 is a cross sectional view of a solenoid of this invention including a butt element having a modified surface.

Referring to FIGS. 5 and 5*a,* in yet another embodiment the solenoid 17 includes an electrically energizable coil 12, a spool 14, a moveable plunger 16, a stationary butt 24, a casing 26, leads 40 and 42 and a pole piece 28. Ferrofluid 44 is positioned (a) within gap 30 between the plunger 16 and the inner wall 20 of spool 14, (b) between but 24 and inner wall 20 of spool 14. A top surface 54 of butt 24 is provided with concentric ridges 56. The concentric ridges 56 effect focusing of a magnetic field within the gap 30 and form a reservoir for the ferrofluid when the ferrofluid mechanically compressed by the plunger 16 is moved toward butt 24 during the forward stroke of the plunger 16. The permanent magnet 46 generates a magnetic field with the magnetic flux lines 37 and 39. Since the magnet is permanent the magnetic field generated by it will be present when the solenoid is not energized thereby helping to retain the ferrofluid. The coil 12 is electrically energized by applying a voltage between leads 40 and 42.

Figure 6:
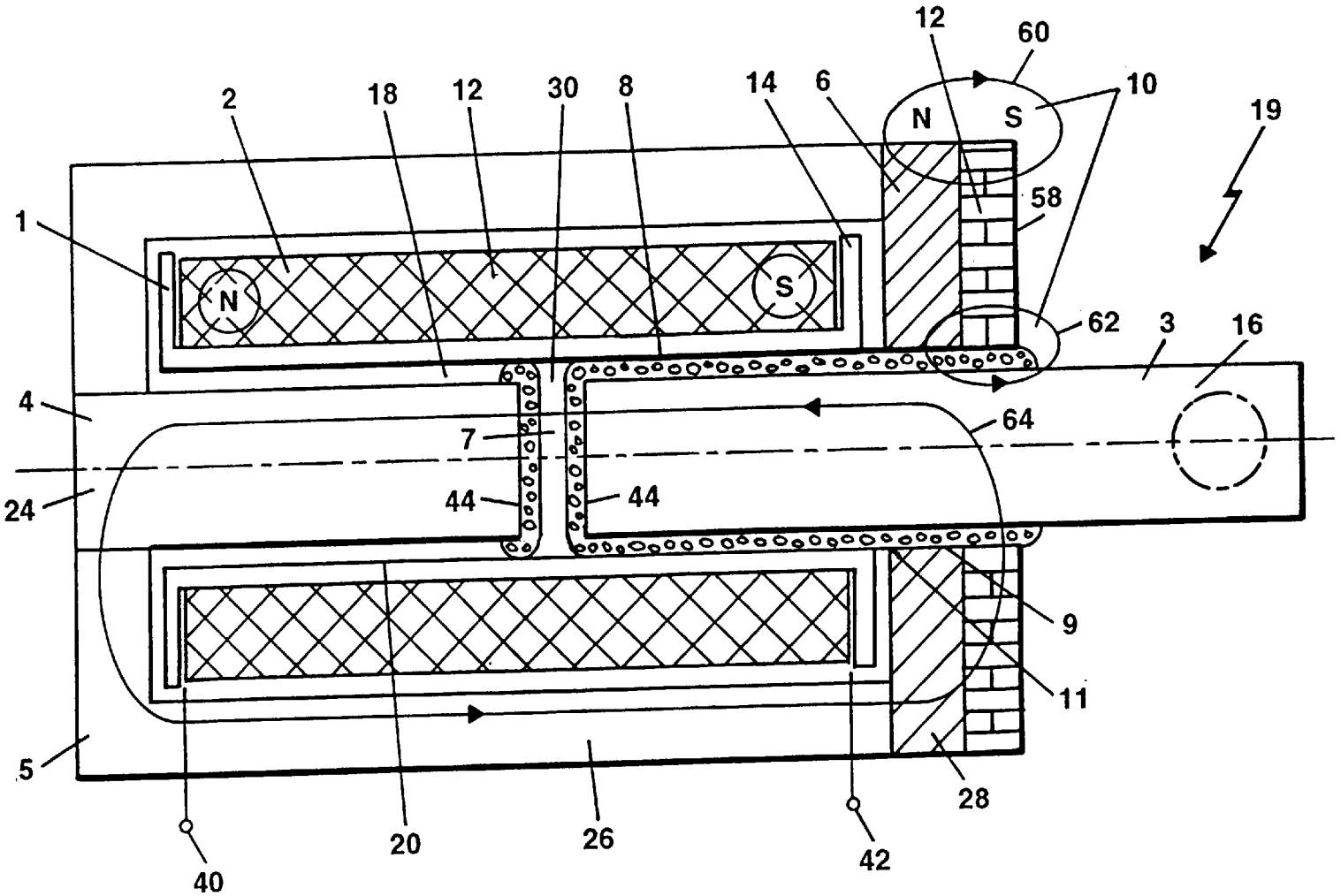
FIG. 6 is a cross sectional view of a solenoid of this invention including a permanent magnet fixed to the pole element.

Referring to FIG. 6 in another embodiment the solenoid 19 includes an electrically energizable coil 12, a spool 14, a moveable plunger 16, a butt 24, a casing 26, leads 40 and 42 and a pole piece 28. Ferrofluid 44 is positioned (a) within the gap 30 between the inner wall 20 of the spool 14 and the butt 24 and (b) between the inner wall 20 of spool 14 and the plunger 16. The solenoid 19 also includes a permanent magnetic 58 generates a magnetic field with the flux lines 60 and 62. The energized coil 12 provides the flux lines 64. The magnetic 58 provides an increased magnetic field in the gap 30 between the plunger 16 and the butt 24 and serves to retain the ferrofluid when the solenoid is not energized. Further the magnetic field in the gap between wall 20 and plunger 16 is increased to provide better alignment of the plunger in the gap.

Figure 7:
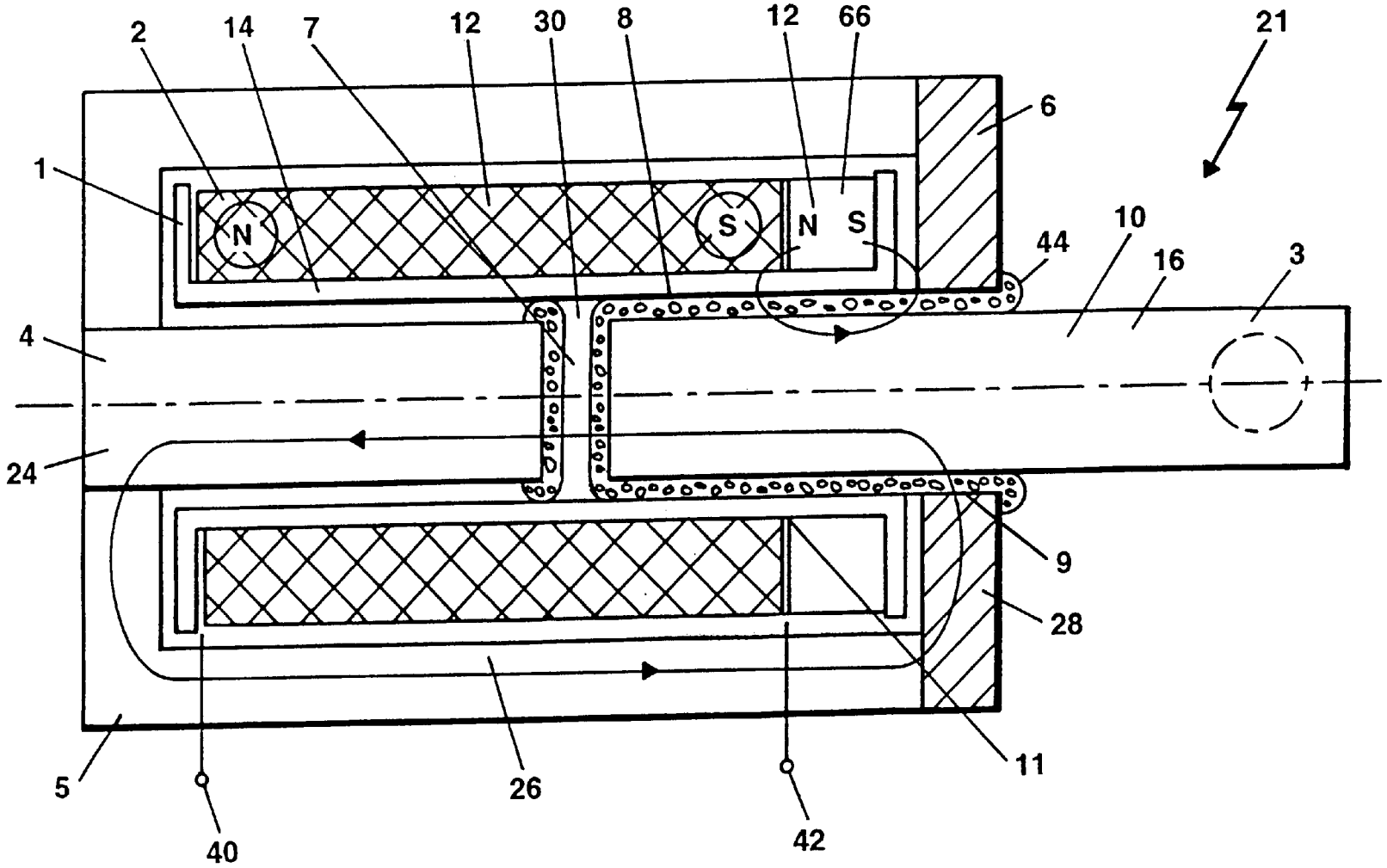
FIG. 7 is a cross sectional view of a solenoid of this invention including a permanent magnet positioned within the solenoid.

Referring to FIG. 7, in a further embodiment the solenoid 21 includes an electrically energizable coil 12, a spool 14, a moveable plunger 16 a butt 24, a casing 26 and a pole piece 28. The coil 12 is energized by applying a voltage between leads 40 and 42. A permanent magnetic 66 is positioned within the spool 14 adjacent the coil 12. A ferrofluid 44 is positioned within gap 30 and is also positioned (a) between the spool 14 and the plunger 16 and (b) between the spool 14 and the butt 24. The magnet 66 increases the magnetic flux within the space between the plunger 16 and the spool 14 as well as in the space between plunger 16 and the pole piece 28. This, in turn, provides increased magnetic force for centering the plunger 16 and for retaining the ferrofluid 44 within the solenoid 21.

Figure 8:
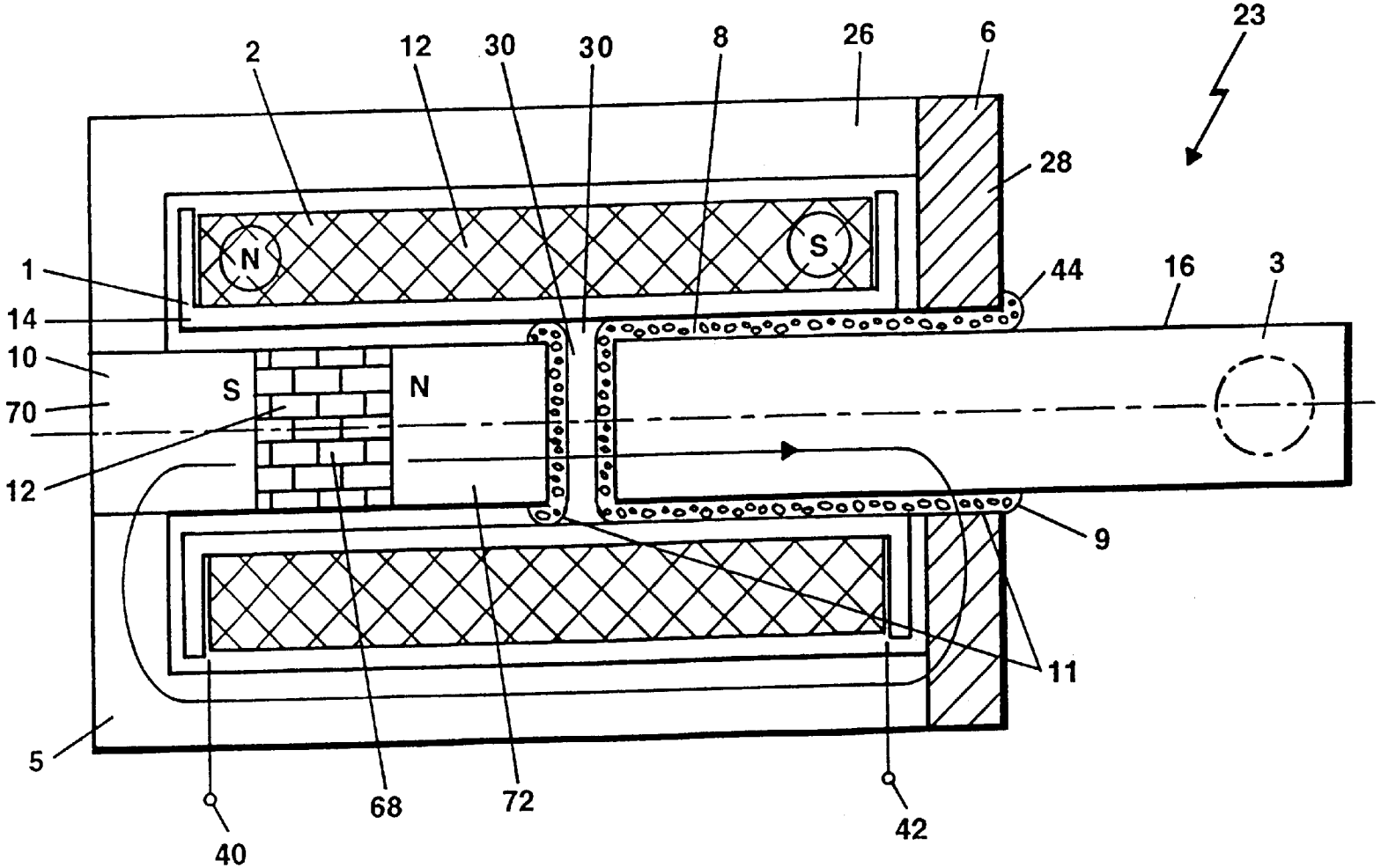
FIG. 8 is a cross sectional view of a solenoid of this invention including a permanent magnet positioned within the butt element.

The embodiment shown in FIG. 8 the solenoid 23 includes electrically energizable coil 12, a spool 14, a moveable plunger 16, a butt 24, a casing 26, leads 40 and 42 and a pole piece 28. A permanent magnet 68 is positioned between butt sections 70 and 72. A ferrofluid 44 is positioned (a) within the gap 30 between plunger 16 and the pole piece 28. Ferrofluid 44 is also positioned between the butt section 72 and the spool 14. The magnet 68 increases the field between the plunger 16 and the spool 14 and between the plunger 16 and the pole piece 28, thereby providing greater retention of ferrofluid 44 within solenoid 23. In addition, the highs magnetic field strength in the gap between the plunger 16 and pole piece 28 provides a higher damping effect thereby further reducing noise produced by the solenoid 23.

Figure 9:
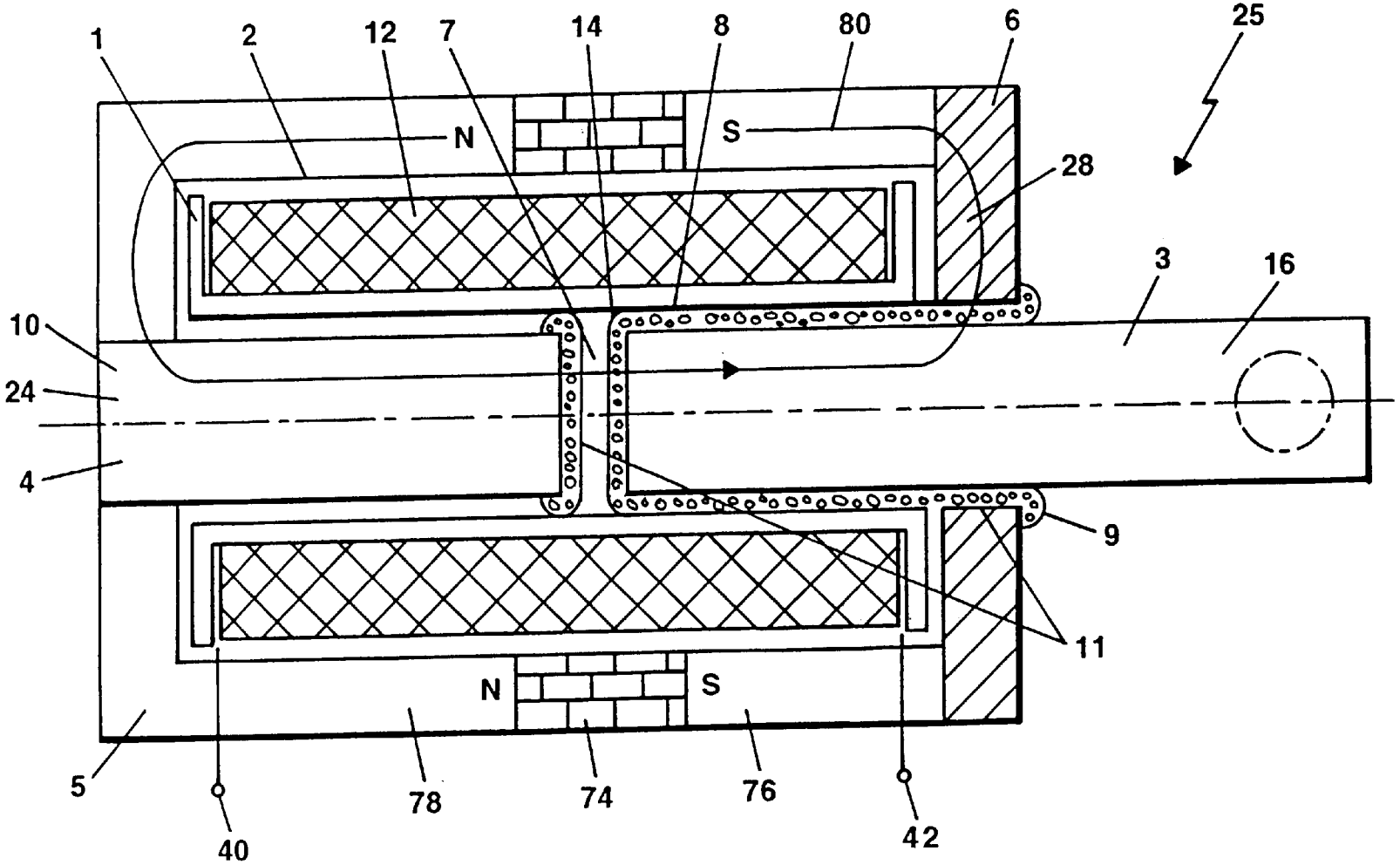
FIG. 9 is a cross sectional view of a solenoid of this invention including a permanent magnet in the casing.

Referring to FIG. 9, the solenoid 25 includes an electrically energizable coil 12, a spool 14, a moveable plunger 16, a butt 24 and a pole piece 28. The coil 12 is provided with leads 40 and 42 to provide an electrical voltage across the coil. A permanent magnet 74 is positioned between segmented casing sections 76 and 78 which are formed from magnetic material such as steel. The magnetic flux lines of the solenoid 25 are represented by line 80. The magnet 74 has the same effect as the magnet discussed above with reference to FIG. 8.

While the solenoid described above with reference to FIGS. 2 through 9 differ in structure by the presence or absence of a permanent magnet and, when present, the location of the permanent magnet as part of the solenoid structure, the solenoids function in essentially the same manner.

The object of the solenoid is to move the plunger 16 between a first position adjacent to or in contact with the butt or to a second position wherein the plunger extends in a position more remote from the butt. Plunger movement in a first direction along an axis is effected by the generated magnetic field. When application of electrical energy ceases, the magnetic field is sufficiently reduced so that a mechanical means in the solenoid, such as a conventionally used spring, effects plunger movement in a direction opposite the first direction along the axis.

Figure 10:
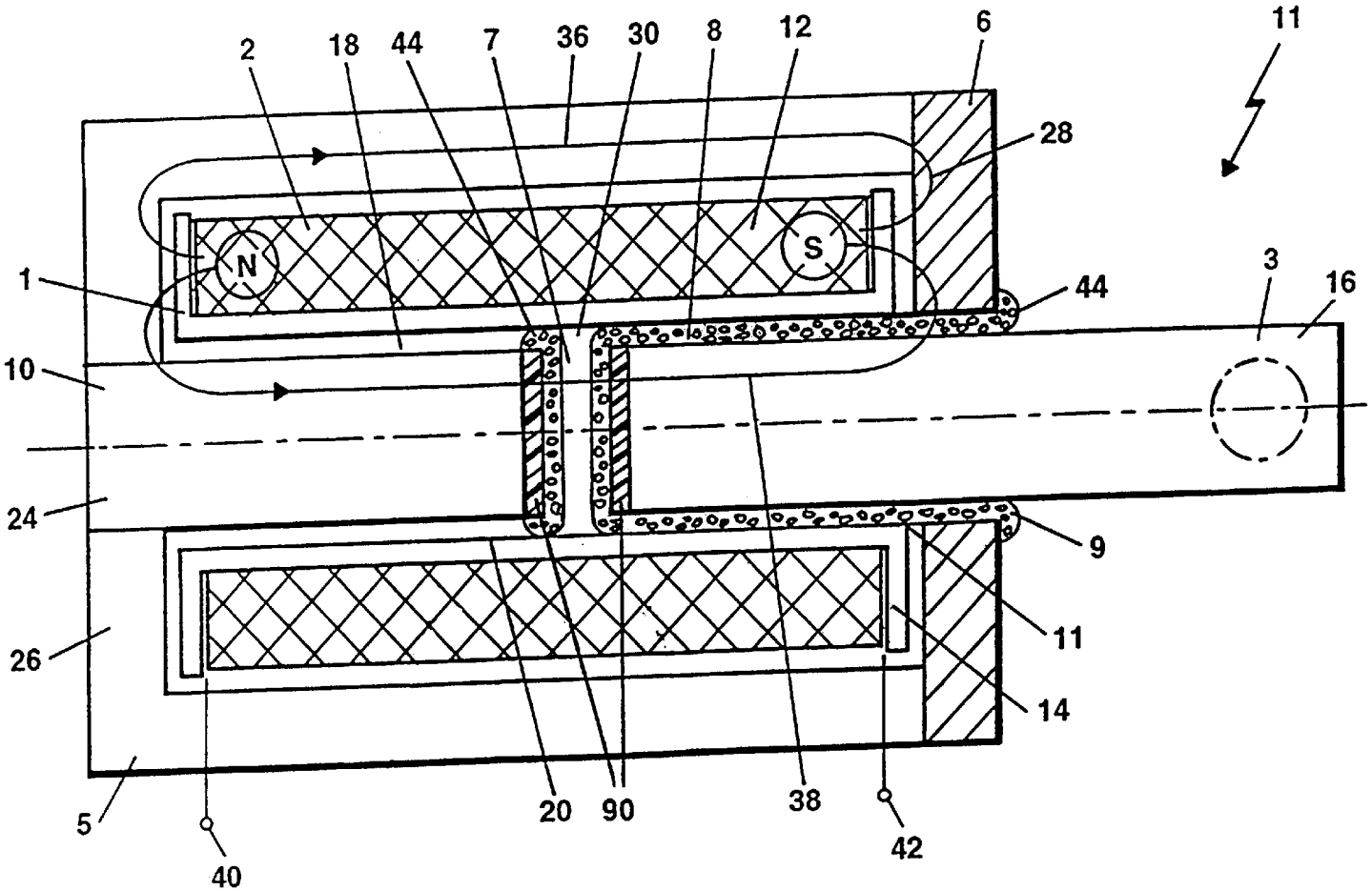
FIG. 10 is a cross sectional view of a solenoid similar to that of FIG. 2, but which has a cushion located between a plunger and a butt of the solenoid.

Shown in FIG. 10 is an alternative embodiment of the invention in which the structure of the apparatus is essentially the same as in FIG. 2, except that a cushion 90 is used in addition to the ferrofluid 44. The cushion 90 is a non-magnetic material which is sound-absorbing, and which is attached to either the face of the plunger 16 or the face of the butt 24. As shown in FIG. 10, a cushion 90 may also be attached to both the plunger 16 and the butt 24. Any of a variety of materials may be used for the cushion 90, although it is preferred that it is resilient in nature (e.g. a plastic, Mylar or elastomer). The material should be strong enough to withstand the repeated impact between the plunger 16 and the butt 24, and should be chemically compatible with the ferrofluid selected for the application. Furthermore, the cushion material should be able to withstand the operating temperature range typical of small solenoids, i.e., between −20° C. and 70° C. Alternatively, the cushion may take the form of a coating (such as Teflon, nylon, plastic or ceramic) on either or both of the plunger 16 and butt 24, provided the coating material and thickness is sufficient to provide a significant damping of acoustical noise.

The use of a cushion as described above makes the solenoid function more quietly. It is known that the magnetic field in the gap between the plunger 16 and butt 24 increases steadily as the plunger approaches the butt, having a maximum value just before the two make contact. The force of the solenoid which is used, for example, to move a valve against a spring, is proportional to the magnetic flux. Since the cushion 90 separates the plunger from the butt, the maximum force is decreased. However, this lost force is restored by the use of the ferrofluid 44 in the gap between the plunger 16 and butt 24, rather than air, since ferrofluid has a higher magnetic permeability than air. Thus, a valve which might be only partially opened with a solenoid having a cushion but no ferrofluid, is completely opened when the cushion and ferrofluid are used together. In addition, the ferrofluid provides lubrication of the moving parts (thereby reducing the generation of wear particles), and helps to align the plunger 16 with the interior of spool 14.

While the invention has been shown and described with regard to a preferred embodiment thereof, it will be recognized by those skilled in the art that various changes in form and detail may be made herein without departing from the spirit and scope of the invention as defined by the appended claims. For example, it will be recognized that the cushion 90 could be adapted for use with the variations shown in any of FIGS. 3–9.

What is claimed is:

1. A solenoid comprising:

a coil apparatus for generating a magnetic field along an axis;

a magnetic plunger positioned in the magnetic field and moveable along the axis;

a mechanical butt for limiting the axial movement of the plunger;

a ferrofluid located between the plunger and the butt;

a cushion located between the plunger and the butt; and a gas located between the plunger and the butt that is vented to atmosphere past a magnetic seal formed by the ferrofluid as the plunger moves toward the butt.

2. The solenoid of claim 1 wherein the coil apparatus surrounds the plunger and the ferrofluid is also located between the coil apparatus and the plunger.

3. The solenoid of claim 2 wherein the magnetic field is a main magnetic field and the solenoid further comprises a supplemental magnetic field source that generates a magnetic field that supplements the main magnetic field so as to increase the magnetic field strength between the coil apparatus and the plunger.

4. The solenoid of claim 3 wherein the supplemental magnetic field source comprises a permanent magnet.

5. The solenoid of claim 1 wherein the magnetic field is a main magnetic field and the solenoid further comprises a supplemental magnetic field source that generates a magnetic field that supplements the main magnetic field so as to increase the magnetic field strength between the plunger and the butt.

6. The solenoid of claim 5 wherein the supplemental magnetic field source comprises a permanent magnet.

7. The solenoid of claim 1 wherein the cushion comprises a resilient material.

8. The solenoid of claim 7 wherein the cushion comprises an elastomer.

9. The solenoid of claim 7 wherein the cushion comprises plastic.

10. The solenoid of claim 7 wherein the cushion comprises polyester.

11. The solenoid of claim 1 wherein the cushion is attached to the plunger.

12. The solenoid of claim 1 wherein the cushion is attached to the butt.

13. The solenoid of claim 1 wherein the cushion comprises at least two pieces, one attached to the plunger and one attached to the butt.

14. The solenoid of claim 1 wherein the cushion comprises a material having good chemical compatibility with the ferrofluid.

15. The solenoid of claim 1 wherein the cushion comprises a material that can withstand temperatures in the range from −20° C. to 70° C.

16. The solenoid of claim 1 wherein the cushion comprises a coating on the surface of at least one of the plunger and the butt.

17. The solenoid of claim 16 wherein the coating comprises at least one of polytetrafluoroethylene, polyester, plastic and ceramic.

18. A solenoid comprising:

a casing formed from a magnetic material;

a pole piece formed from a magnetic composition wherein the casing and pole piece are joined to form a housing having an internal volume;

a electrically energizable coil positioned within said internal volume;

a support means for said coil formed from a nonmagnetic composition, said support means having a core volume;

a moveable plunger positioned within said core volume and extending through said housing;

a stop means positioned within said core volume for limiting axial movement of said plunger;

a ferrofluid positioned within said core volume between said stop means and said plunger and between said plunger and said support means;

means for electrically energizing said coil;

a cushion positioned between the plunger and the butt and a gas located between the plunger and the butt that is vented to atmosphere past a magnetic seal formed by the ferrofluid as the plunger moves toward the butt.

* * * * *